US007252596B1

(12) United States Patent
Matousek

(10) Patent No.: US 7,252,596 B1
(45) Date of Patent: Aug. 7, 2007

(54) PUTTER ALIGNMENT DEVICE

(76) Inventor: Thomas G. Matousek, 4129 S. Arthur Ave., Brookfield, IL (US) 60513

( * ) Notice: Subject to any disclaimer, the term of this patent is extended or adjusted under 35 U.S.C. 154(b) by 143 days.

(21) Appl. No.: 11/139,855

(22) Filed: May 31, 2005

(51) Int. Cl.
*A63B 69/36* (2006.01)

(52) U.S. Cl. ..... 473/226; 473/240; 473/241

(58) Field of Classification Search ..... 473/240, 473/241, 226, 231, 404, 268; 33/508, 263, 33/286, 333, 334, 337, 370–373
See application file for complete search history.

(56) References Cited

U.S. PATENT DOCUMENTS

| | | | | | |
|---|---|---|---|---|---|
| 1,167,967 | A | * | 1/1916 | Anderson | 396/50 |
| 1,556,062 | A | * | 10/1925 | Baugh | 356/255 |
| 2,463,291 | A | * | 3/1949 | Mazziotti | 473/240 |
| 2,822,614 | A | * | 2/1958 | Susinno | 33/263 |
| 3,118,678 | A | * | 1/1964 | Rohr | 473/240 |
| 3,198,525 | A | * | 8/1965 | Smith | 473/238 |
| 4,079,520 | A | * | 3/1978 | Davis | 473/241 |
| 4,116,448 | A | | 9/1978 | Crowe, Jr. | |
| 4,480,390 | A | * | 11/1984 | Frissora et al. | 33/286 |
| 4,601,472 | A | | 7/1986 | O'Flanagan | |
| 4,884,813 | A | * | 12/1989 | Cates | 473/268 |
| 4,934,706 | A | * | 6/1990 | Marshall | 473/241 |
| 5,431,391 | A | * | 7/1995 | Tracey | 473/257 |
| 5,492,322 | A | * | 2/1996 | Smith | 473/404 |
| 5,509,657 | A | * | 4/1996 | Guthry | 473/241 |
| 5,672,117 | A | * | 9/1997 | Dar | 473/232 |
| 6,146,285 | A | | 11/2000 | Winslow | |
| 2005/0043120 | A1 | * | 2/2005 | Garza | 473/404 |

* cited by examiner

*Primary Examiner*—Sebastiano Passaniti
(74) *Attorney, Agent, or Firm*—Crossley Patent Law; Mark A. Crossley

(57) ABSTRACT

A golf club alignment device, especially for use with a putter, the device comprising a viewer which removably and adjustably attaches to the shaft of a club. The device provides for viewing downwardly to see the target which is horizontally distant from the user, the device providing a level for leveling and a crosshair sight for indicating slope of the surface and the position of the club face with relation to the slope, the device further providing for adjustable location above the club head.

11 Claims, 7 Drawing Sheets

PUTTER ALIGNMENT DEVICE

BACKGROUND OF THE INVENTION

Reading a slope of a golf surface has been a challenge since the advent of the game. Reading a club's position relative to the ball and to a surface is also challenging. While devices have been presented to aid in the above challenges, limitations are present in performing all functions needed in assisting a golfer in aligning and executing his shot toward a hole. Ideally, a device to aid in club alignment should be adjustably positionable along the shaft of the club. Adding a device to a club head or club face causes club imbalances that most golfers do not wish to deal with. Also, any device, especially in putting, should be positionable directly in a user's line of sight to the club head. The present invention uniquely meets these challenges, as well as providing a device that can be used separately from a golf club.

FIELD OF THE INVENTION

The invention relates to golfing aids and more specifically to a golf club alignment device that aids in correctly aligning a golf shot to reach a target hole.

SUMMARY OF THE INVENTION

The general purpose of the putter alignment device, described subsequently in greater detail, is to provide a putter alignment device which has many novel features that result in an improved putter alignment device which is not anticipated, rendered obvious, suggested, or even implied by prior art, either alone or in combination thereof.

The invention is a putter alignment device for use on the shaft of a golf club. Although the golf club pictured is a putter, the invention is capable of use on other clubs. The invention is also removed from a club and used as a freely held device. The invention is removably and adjustably clamped to the shaft of the club. The invention is clamped between the grip and the head. Latitude in the location of the invention allows a user to fit the invention as desired, allowing for balance as well as visual input. The invention comprises a parallelepiped reflection chamber. The chamber has a chamber top and a chamber front. The chamber front is perpendicular to the chamber top. The chamber further comprises a reflector. The bottom of the upper barrel is connected to the chamber top.

The upper barrel communicates visually with the reflector in the reflection chamber at a 45 degree angle. The upper barrel has a top and a bottom. The lower barrel has a back and a front. The back of the lower barrel is connected to the chamber front of the reflection chamber. The lower barrel communicates visually with the reflector at a 45 degree angle. The barrels and chamber are hollow. The barrels are cylindrical. Cross hairs are centrally disposed within the front of the lower barrel. The clamp assembly provides for removable and adjustable attachment of the invention to the shaft of the club. The clamp assembly provides for positioning the invention anywhere along the length of the shaft between the grip and the head. The invention is ideally positioned along the shaft such that the invention is above the head. The clamp assembly partially comprises a parallelepiped clamp base having a length. A clamp is removably affixed to the clamp base. The shaft receiver is within the clamp and the clamp base. The tensioning knobs removably affix the clamp to the clamp base. The tensioning knobs are snugged to removably affix the invention along the shaft.

The pivot rod extends from the length of the clamp base. The clamp which encircles the pivot rod is hereinafter referred to as the circlamp. The circlamp is attached to the bottom of the reflection chamber. The circlamp removably and slideably receives the pivot rod of the clamp base. The reflection chamber is thereby positioned laterally away from the shaft. The tensioning knob within the circlamp tightens the circlamp about the pivot rod. The clamp assembly thereby removably and pivotally fastens the invention to the club shaft. The crosshairs provide sighting means for sighting a target hole. The upwardly visible bubble level is disposed atop the lower barrel.

The line of sight through the invention provides viewing through the top of the upper barrel, thence a reflection via the reflector, thence through the lower barrel. The bubble level provides for leveling the invention such that any slope to the target surface is discernable.

A user holds the grip of the golf club. Ideally, head of the user is directly over the head of the club. The invention is positioned above the club head. The invention is aligned with the club head such that the lower barrel is perpendicular to the club face. The flag is visible through the upper barrel. The level is aligned such that the bubble is centered. The crosshairs are positioned to align with the flag. If the crosshairs show that a slope exists on the surface, the crosshairs are moved to be positioned beside the flag to prepare for putting the ball to the hole. The crosshairs are positioned beside the flag in order to compensate for the slope of the putting surface. One crosshair corresponds with the flag; the other corresponds with the surface. The surface will cause the ball to fall down the slope. The amount of difference between the crosshair and the slope teaches a user how far to move the other crosshair from the flag. The crosshairs further assist in indicating the planar position of the invention with respect to the target hole and the target surface.

Thus has been broadly outlined the more important features of the putter alignment device so that the detailed description thereof that follows may be better understood and in order that the present contribution to the art may be better appreciated.

Numerous objects, features and advantages of the putter alignment device will be readily apparent to those of ordinary skill in the art upon reading the following detailed description of presently preferred, but nonetheless illustrative, examples of the putter alignment device when taken in conjunction with the accompanying drawings. In this respect, before explaining the current examples of the putter alignment device in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the putter alignment device. It is therefore important that the claims be regarded as including such equivalent constructions insofar as they do not depart from the spirit and scope of the present invention.

Objects of the putter alignment device, along with various novel features that characterize the invention are particularly pointed out in the claims forming a part of this disclosure.

For better understanding of the putter alignment device, its operating advantages and specific objects attained by its uses, refer to the accompanying drawings and description.

DETAILED DESCRIPTION OF THE DRAWINGS

With reference now to the drawings, and in particular FIGS. 1 through 7 thereof, example of the putter alignment device employing the principles and concepts of the present invention and generally designated by the reference number 10 will be described.

Figure 1:
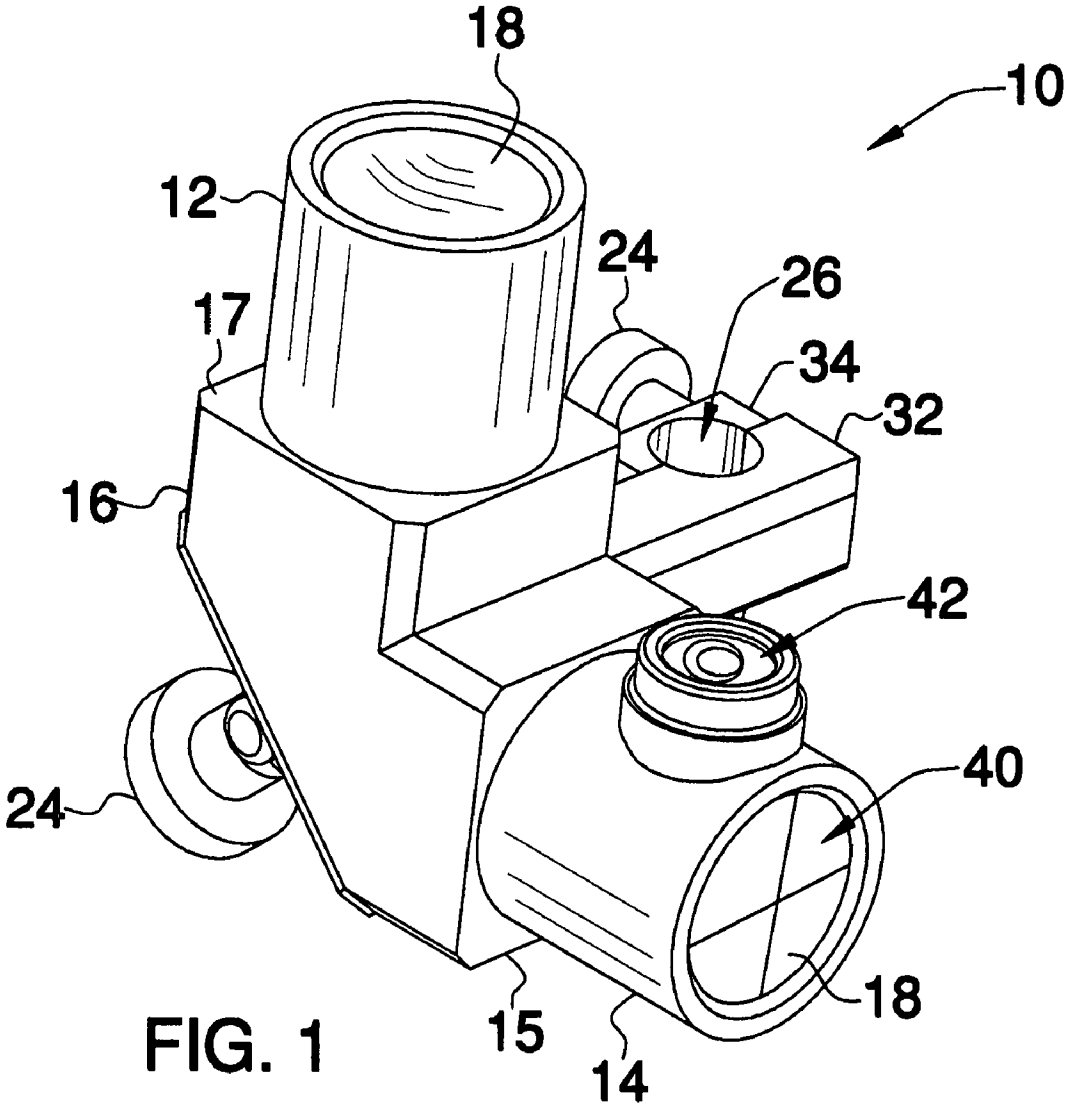
FIG. 1 is a perspective view of the invention.
Figure 5:
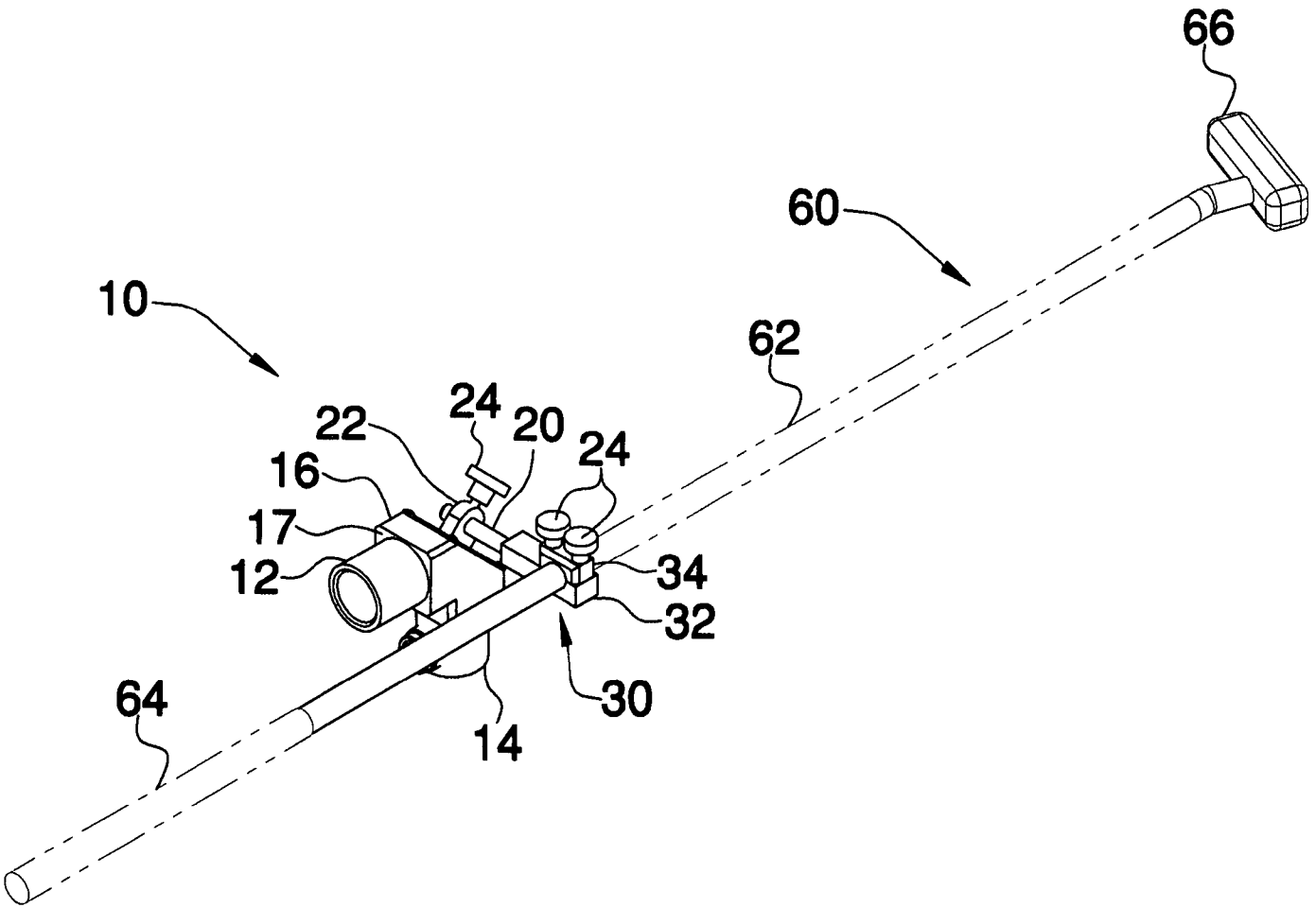
FIG. 5 is a perspective view of the invention installed on the shaft of a golf putter.

Referring to FIGS. 1 and 5, the invention 10 is a putter alignment device for use on the shaft 62 of a golf club 60. The golf club 60 pictured is a putter. The invention 10 is removably and adjustably clamped to the shaft 62 of the club 60. The invention 10 is clamped between the grip 64 and the head 66. The invention 10 comprises a parallelepiped reflection chamber 16. The chamber 16 has a chamber top 17 and a chamber front 15. The chamber front 15 is perpendicular to the chamber top 17. The bottom of the upper barrel 12 is connected to the chamber top 17. The upper barrel 12 communicates visually with the reflection chamber 16. The upper barrel 12 has a top and a bottom. The lower barrel 14 has a back and a front. The back of the lower barrel 14 is connected to the chamber front 15 of the reflection chamber 16. The lower barrel 14 communicates visually with the reflection chamber 16. Cross hairs 40 are centrally disposed within the front of the lower barrel 14. The clamp assembly 30 provides for removable and adjustable attachment of the invention 10 to the shaft 62 of the club 60. The clamp assembly 30 provides for positioning the invention 10 anywhere along the length of the shaft 62 between the grip 64 and the head 66.

The invention 10 is ideally positioned along the shaft 62 such that the invention 10 is above the head 66. The clamp assembly 30 partially comprises a parallelepiped clamp base 32 having a length. A clamp 34 is removably affixed to the clamp base 32. The shaft receiver 26 is within the clamp 34 and the clamp base 32. The tensioning knobs 24 removably affix the clamp 34 to the clamp base 32. The tensioning knobs 24 are snugged to removably affix the invention 10 along the shaft 62. The pivot rod 20 extends from the length of the clamp base 32. The circlamp 22 is attached to the bottom of the reflection chamber 16. The circlamp 22 removably and slideably receives the pivot rod 20 of the clamp base 32. The reflection chamber 16 is thereby positioned laterally away from the shaft 62. The tensioning knob 24 within the circlamp 22 tightens the circlamp 22 about the pivot rod 20. The clamp assembly 30 thereby removably and pivotally fastens the invention 10 to the club shaft 62. The crosshairs 40 provide sighting means for sighting a target. The upwardly visible bubble level 42 is disposed atop the lower barrel 14.

Figure 2:
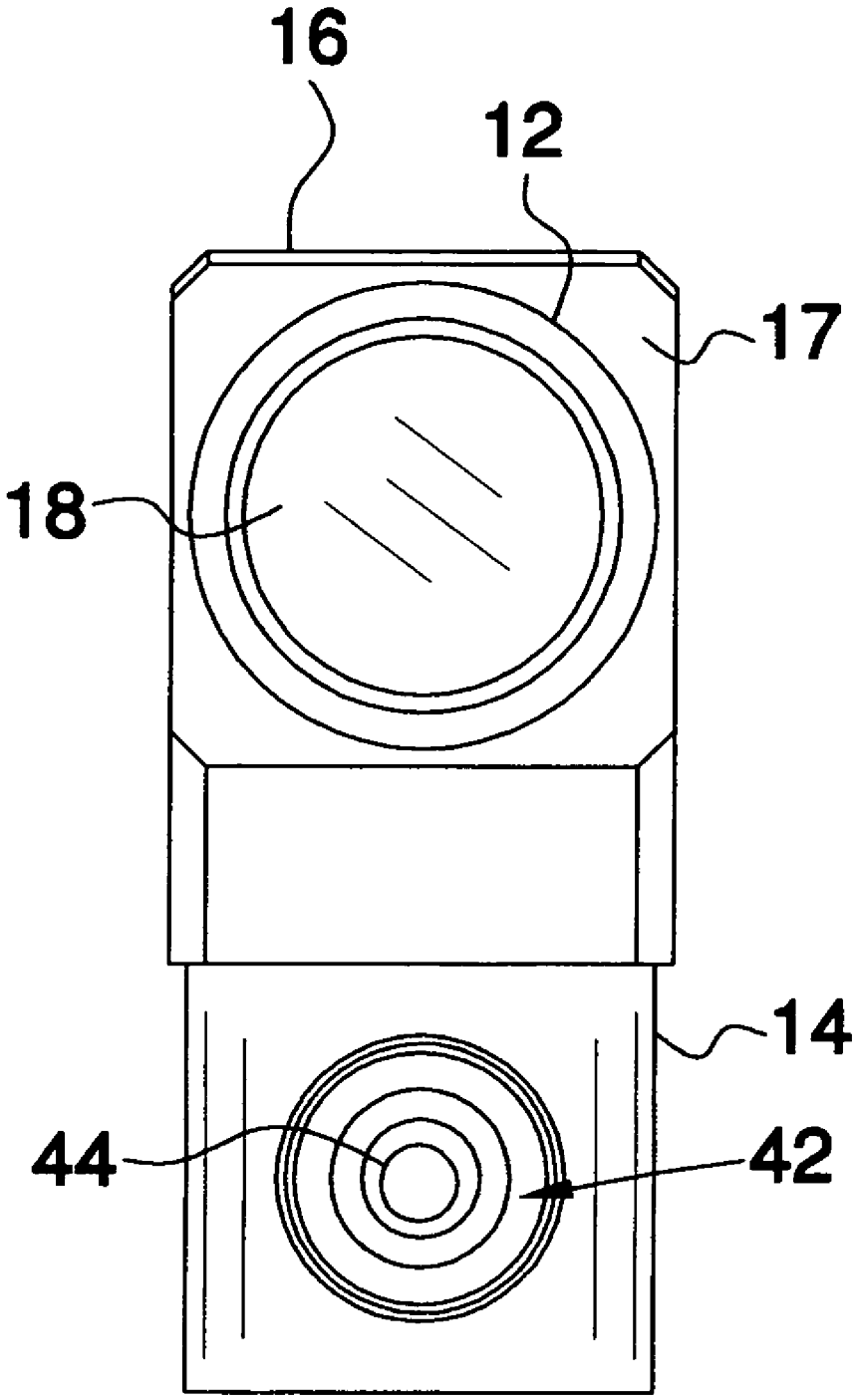
FIG. 2 is a top plan view of the invention upper barrel, reflection chamber, and lower barrel.
Figure 3:
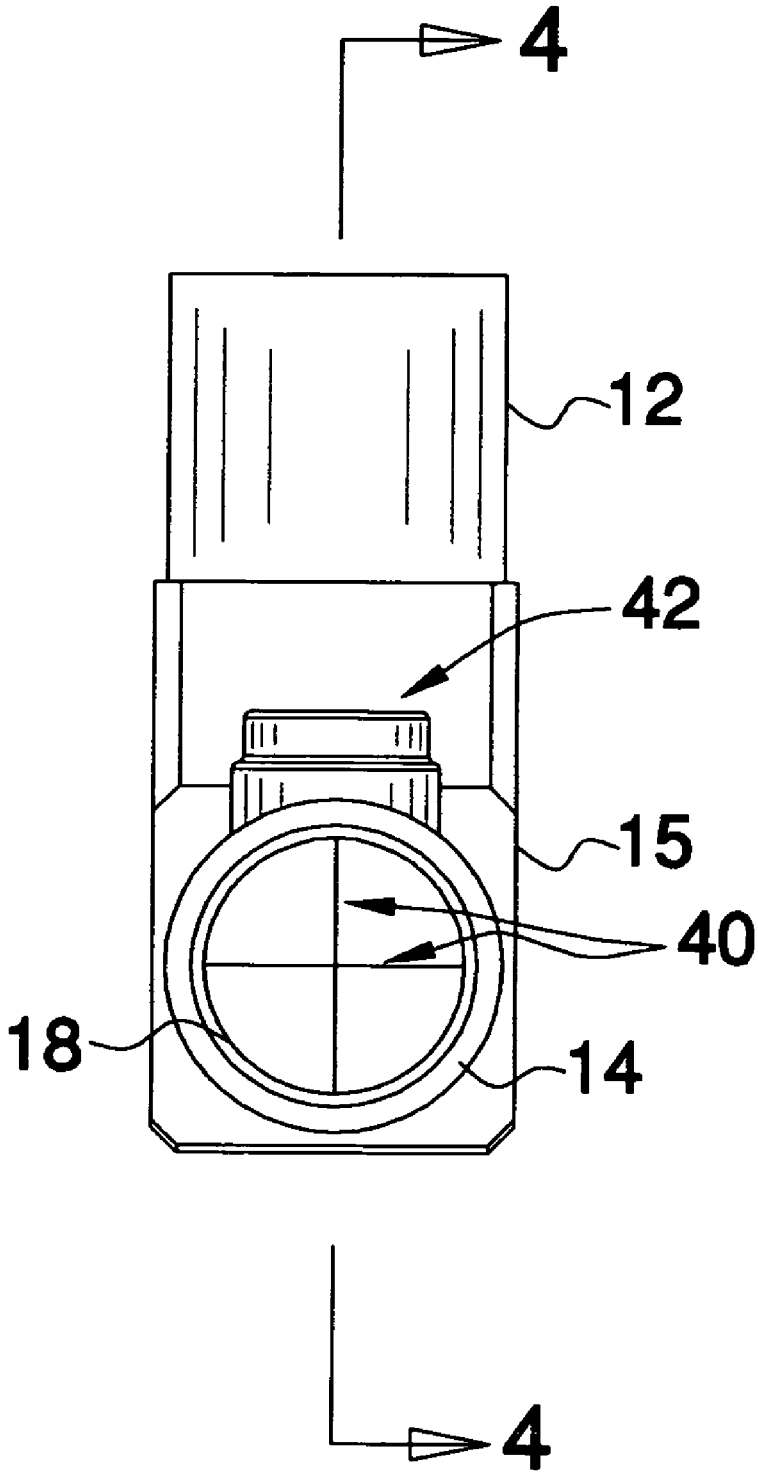
FIG. 3 is a front elevation view of the invention lower barrel, reflection chamber, and upper barrel.
Figure 4:
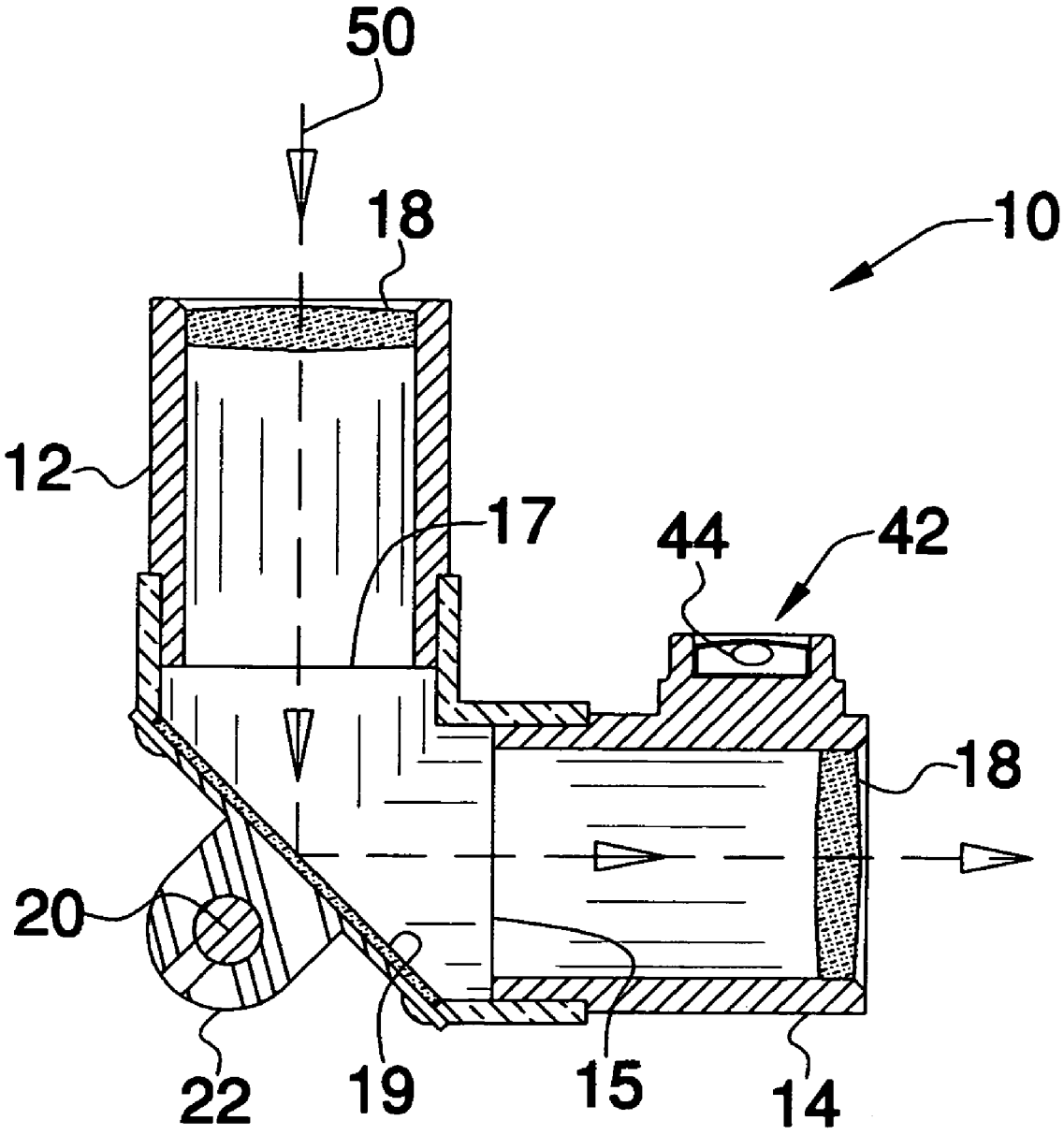
FIG. 4 is a cross sectional view of FIG. 3 taken along the line 4-4

Referring to FIGS. 2, 3, and 4, the bottom of the upper barrel 12 is affixed to the chamber top 17 of the generally parallelepiped reflection chamber 16. The back of the lower barrel 14 is affixed to the front of the chamber 16. The lens 18 is disposed within the top of the upper barrel 12. A lens 18 is disposed within the front of the lower barrel 14. The reflector 19 is positioned within the chamber 16 at a 45 degree angle to both the upper barrel 12 and the lower barrel 14. The upper barrel 12, the chamber 16, and the lower barrel 14 are in visual communication. The upper barrel 12, the chamber 16, and the lower barrel 14 are hollow.

The upper barrel 12 and the lower barrel 14 are cylindrical. The line of sight 50 provides viewing through the top of the upper barrel 12, thence a reflection via the reflector 19, thence through the lower barrel 14. The bubble level 42 is affixed atop the lower barrel 14.

Figure 6:
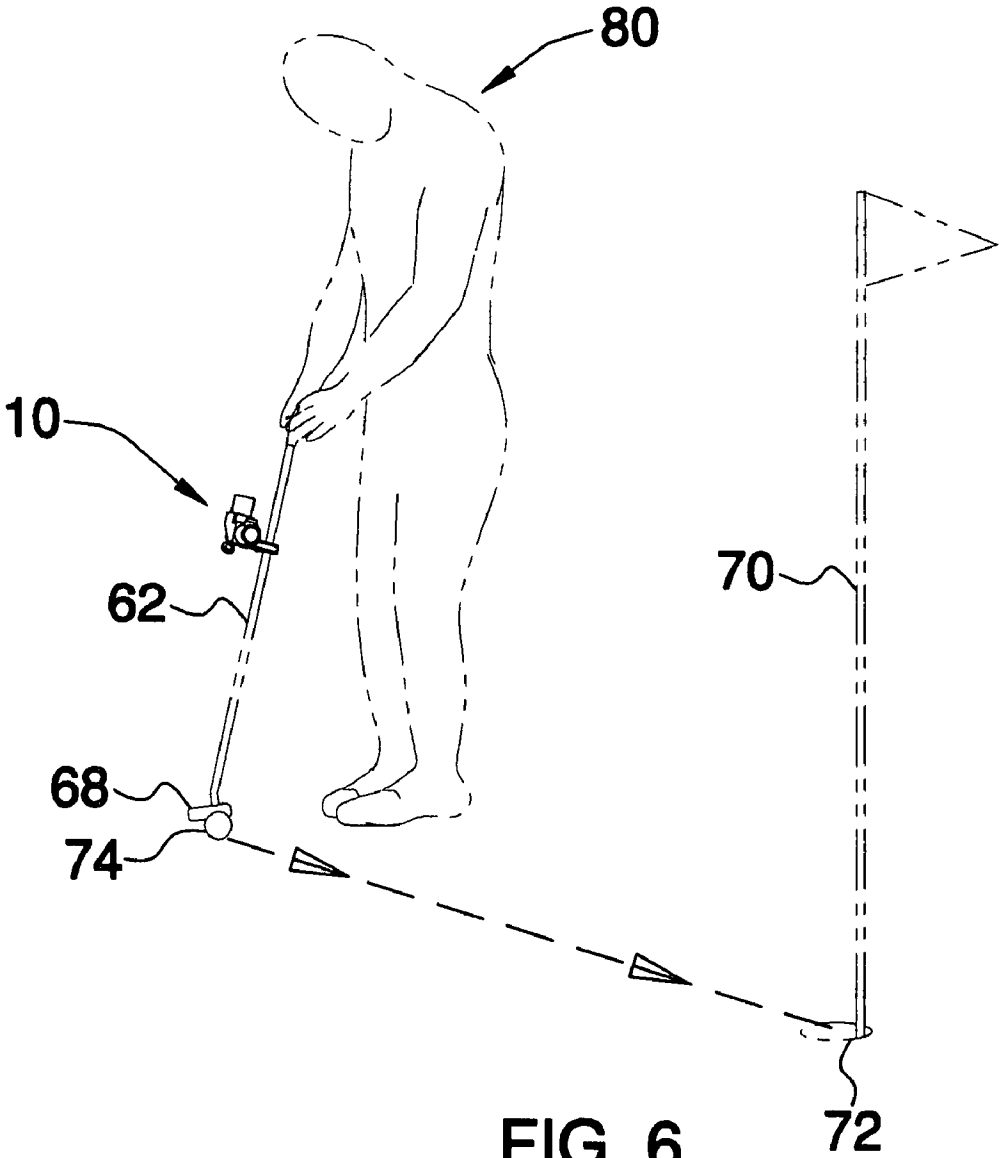
FIG. 6 is a perspective view of the invention in use with a putter.
Figure 7:
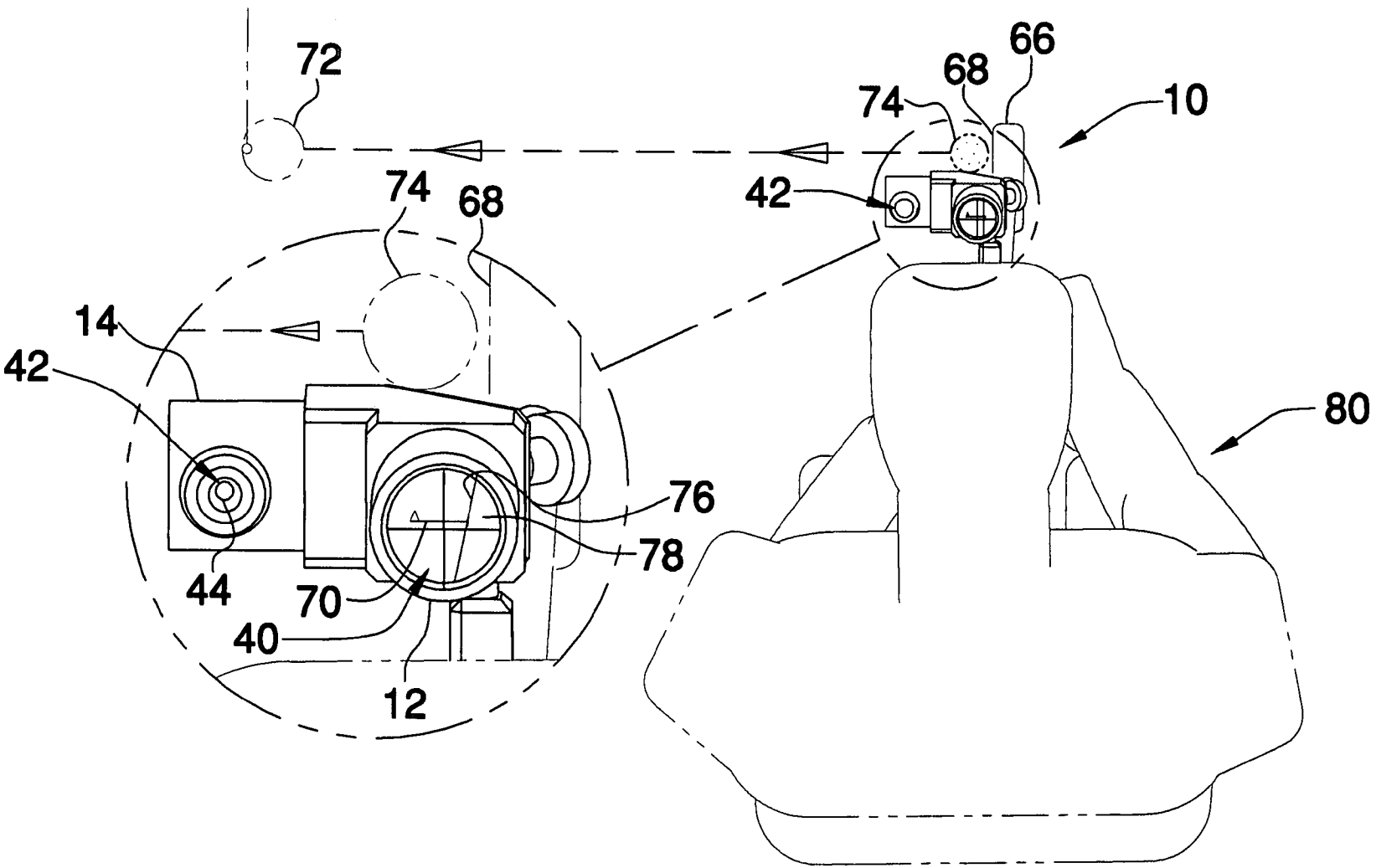
FIG. 7 is a top perspective view of the invention in use.

Referring to FIGS. 6 and 7, the user 80 holds the grip 64 of the golf club 60. The head of the user 80 approaches a position directly over the club head 66. The user 80 is positioned for the sake of visibility in FIG. 7. Ideally, the head of the user 80 is directly over the head 66 of the club 60. The invention 10 is positioned above the club head 66. The invention 10 is aligned with the club head 66 such that the lower barrel 14 is perpendicular to the club face 68. The flag 70 is visible through the upper barrel 12. The level 42 is aligned such that the bubble 44 is centered. The crosshairs 40 are positioned beside the flag 70 to prepare for putting the ball 74 to the hole 72. The crosshairs 40 are positioned beside the flag 70 in order to compensate for the slope 76 of the putting surface 78. The surface 78 will cause the ball 74 to fall down the slope 76. The amount of difference between the crosshairs 40 and the slope 76 teaches a user 80 how far to move the crosshairs 40 from the flag 70. The crosshairs 40 further assist in indicating the planar position of the invention 10 with respect to the target hole 72 and the target surface 78.

With respect to the above description then, it is to be realized that the optimum dimensional relationships for the parts of the putter alignment device, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A putter alignment device for use on the shaft of a golf club, the device comprising:

a viewer for attachment to the shaft, the viewer providing a view of a target in front of the club when the viewer is looked into from above, the viewer comprising:

a parallelepiped reflection chamber, the chamber having a top and a front perpendicular to the top;

a reflector within the reflection chamber;

an upper barrel connected to the top of the reflection chamber, the upper barrel communicating with the reflector at a 45 degree angle, the upper barrel having a top and a bottom;

a lower barrel connected to the front of the reflection chamber, the lower barrel communicating with the reflector at a 45 degree angle, the lower barrel having a front and a back;

attachment means for attaching the viewer to the shaft of the club;

adjustment means for adjustably positioning the viewer to be above a head of the club;

a clamp assembly pivotally affixed to the viewer, the clamp assembly comprising:

a parallelepiped clamp base having a length;

a clamp removably affixed to the clamp base;

a shaft receiver within the clamp and the clamp base;

more than one tensioning knob removably affixing the clamp to the clamp base;

a pivot rod extending from the length of the clamp base;

a circlamp attached to a bottom of the reflection chamber of the viewer, the circlamp removably and slideably receiving the pivot rod of the clamp base;

a tensioning knob within the circlamp, the tensioning knob for tightening the circlamp about the pivot rod, whereby the clamp assembly removably and pivotally fastens the viewer to the club shaft, the viewer laterally disposed from the club shaft to be positioned generally above the club head;

sighting means for sighting the target through the viewer, whereby the head of the club is aligned with the target, the level indicating the slope of the target surface;

an upwardly visible level disposed upon the lower barrel of the viewer, the level for indicating the planar position of the viewer with respect to the target and a target surface.

2. The device in claim 1 wherein a lens is disposed within the top of the upper barrel.

3. The device in claim 2 wherein a lens is disposed within the front of the lower barrel.

4. The device in claim 3 wherein the reflector and the lower barrel lens provide magnification of the target.

5. The device in claim 4 wherein the viewer attachment means provides for removable attachment of the viewer from the club shaft, whereby the viewer is used separately from the golf club.

6. The device in claim 5 wherein the viewer attachment means provides for removable attachment of the viewer from the club shaft, whereby the viewer is used separately from the golf club.

7. A putter alignment device for use on the shaft of a golf club, the device comprising:

a viewer for attachment to the shaft, the viewer providing a view of a target in front of the club when the viewer is looked into from above, the viewer comprising:

a parallelepiped reflection chamber, the chamber having a top and a front perpendicular to the top;

a reflector within the reflection chamber;

an upper barrel connected to the top of the reflection chamber, the upper barrel communicating with the reflector at a 45 degree angle, the upper barrel having a top and a bottom;

a lower barrel having a back and a front, the back connected to the front of the reflection chamber, the lower barrel communicating with the reflector at a 45 degree angle, the lower barrel having a front and a back;

cross hairs centrally disposed within the front of the lower barrel;

attachment means for attaching the viewer to the shaft of the club;

adjustment means for adjustably positioning the viewer to be above a head of the club;

a clamp assembly pivotally affixed to the viewer, the clamp assembly comprising:

a parallelepiped clamp base having a length;

a clamp removably affixed to the clamp base;

a shaft receiver within the clamp and the clamp base;

more than one tensioning knob removably affixing the clamp to the clamp base;

a pivot rod extending from the length of the clamp base;

a circlamp attached to a bottom of the reflection chamber of the viewer, the circlamp removably and slideably receiving the pivot rod of the clamp base;

a tensioning knob within the circlamp, the tensioning knob for tightening the circlamp about the pivot rod, whereby the clamp assembly removably and pivotally fastens the viewer to the club shaft, the viewer laterally disposed from the club shaft to be positioned generally above the club head;

sighting means for sighting the target through the viewer, whereby the head of the club is aligned with the target, the level indicating the slope of the target surface;

an upwardly visible bubble level disposed upon the lower barrel of the viewer, the level for indicating the planar position of the viewer with respect to the target and a target surface.

8. The device in claim 7 wherein a lens is disposed within the top of the upper barrel.

9. The device in claim 8 wherein a lens is disposed within the front of the lower barrel.

10. The device in claim 9 wherein the reflector and the lower barrel lens provide magnification of the target.

11. The device in claim 9 wherein the viewer attachment means provides for removable attachment of the viewer from the club shaft, whereby the viewer is used separately from the golf club.

* * * * *